US008663134B2

(12) United States Patent
Takahashi et al.

(10) Patent No.: US 8,663,134 B2
(45) Date of Patent: Mar. 4, 2014

(54) WALKING ASSISTANCE DEVICE

(75) Inventors: Hideaki Takahashi, Wako (JP); Hideo Shimizu, Wako (JP); Taiji Koyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 410 days.

(21) Appl. No.: 12/987,405

(22) Filed: Jan. 10, 2011

(65) Prior Publication Data

US 2011/0172571 A1 Jul. 14, 2011

(30) Foreign Application Priority Data

Jan. 11, 2010 (JP) ..... 2010-003501
Jan. 11, 2010 (JP) ..... 2010-003507

(51) Int. Cl.
*A61H 1/02* (2006.01)
*A61H 3/00* (2006.01)

(52) U.S. Cl.
USPC ..... 601/35; 601/5; 602/23

(58) Field of Classification Search
USPC ..... 601/5, 23, 24, 26, 33, 34, 35, 84, 97, 601/98; 602/5, 6, 12, 16, 19, 23, 24, 25, 26, 602/32, 36
See application file for complete search history.

(56) References Cited

U.S. PATENT DOCUMENTS 5,749,838 A * 5/1998 Kline ..... 601/71

FOREIGN PATENT DOCUMENTS

| | | | | |
|---|---|---|---|---|
| JP | 11-225858 | | 8/1999 | |
| JP | 2005-000634 | | 1/2005 | |
| JP | 2005-523759 | | 8/2005 | |
| JP | 2008-79809 | | 4/2008 | |
| JP | 2009-21059 | | 1/2009 | |
| JP | 2009-48782 | | 3/2009 | |
| JP | 2009-095645 | | 5/2009 | |
| WO | WO 2009/040987 | * | 4/2009 | ..... A61F 5/00 |

* cited by examiner

*Primary Examiner* — Quang D Thanh
(74) *Attorney, Agent, or Firm* — Rankin, Hill & Clark LLP

(57) ABSTRACT

In a walking assistance device (10) including a main frame (22) supporting a power generator (26, 28) and worn on a pelvic part of a user, the main frame is provided with an opening (23) in a middle part thereof, and an electronic unit (25) is received in the opening. As the electronic unit is placed in the middle part of the main frame which is relatively free from deformation, the electronic unit is protected from deformation or stress that could impair the reliability of the electronic unit. To achieve both an easy access to the electronic unit, and an attractive appearance, the opening may be provided with a lid (24) that selectively closes the opening from a side adjacent to the user, and the lid may be formed as a back support member for supporting a back part of the user. As the lid serves the dual purposes, the weight and cost of the device can be minimized. For the convenience of the handling of the lid, the lid may be supported by the main frame via a hinge (121) provided adjacent to an upper or lower part of the opening.

9 Claims, 7 Drawing Sheets

WALKING ASSISTANCE DEVICE

TECHNICAL FIELD

The present invention relates to a walking assistance device, and in particular to a walking assistance device including a femoral support member configured to be worn on a femoral part of a user to apply thereto a walking assistance force generated by a power generator.

BACKGROUND OF THE INVENTION

Previously proposed is a walking assistance device that includes a power generator such as an electric motor to apply a working assistance force to a lower limb of a user for the purposes of assisting the walking movement of the user, and/or rehabilitating the walking impairment of the user by helping the user to regain the motor coordination that is required for the user to walk.

Such a walking assistance device typically includes a pelvic frame consisting of a C-shaped main frame configured to be worn on a pelvic part of the user and extending from a lower back part of the user to either side of the pelvic part of the user and an abdominal belt for securing the main frame to the pelvic part of the user, a pair of power generators mounted on either lateral end of the pelvic frame (at parts corresponding to the hip joints of the user) and a pair of femoral support members for transmitting the power generated by the power generators to the corresponding femoral parts of the user. See patent document 1 (Japanese patent laid-open publication JP2009-95645A).

A walking assistance device of this kind requires an electronic control unit and a battery for executing the required control action and providing the electric power to the power generator. It is most convenient if such electronic/electric units can be mounted on the pelvic frame. However, because the pelvic support assembly is worn closely on the body of the user, and is limited in space, there is some difficulty in placing the electronic/electric units on or in the pelvic frame.

Also, the pelvic frame is configured to support the load (weight and reaction force) of the walking assistance device, and is given with an adequate mechanical strength, but inevitably undergoes some deformation during use. If the deformation of the main frame is transmitted to the electronic/electric units, the durability and reliability of the electronic/electric units may be impaired. This problem can be overcome by increasing the stiffness of the main frame, but it adds to the weight and cost of the main frame.

It is also important that the electronic/electric units are placed in such a part of the walking assistance device that can be readily accessed in view of the need to service the electronic/electric units and replace a component thereof from time to time.

The electronic/electric units often generate heat in operation, and there may be a need to insulate the user from the heat.

It is known to provided a back support member on a middle part of the main frame facing a lower back part of the user for the purpose of evenly distributing the load (weight and reaction force) of the walking assistance device uniformly over the body of the user and maximize the comfort of the user. See patent document 2 (Japanese patent laid-open publication JP2005-000634A). The inventors have realized that the back support member can be used not only for supporting a lower back part of the user but also as a part of the enclosure for receiving electronic/electric units and prevent the transmission of heat from the electronic/electric units of the user.

BRIEF SUMMARY OF THE INVENTION

In view of such problems of the prior art and the recognition of the inventors, a primary object of the present invention is to provide a walking assistance device that is configured to store an electric/electronic unit free from stress without increasing the overall weight of the walking assistance device.

A second object of the present invention is to provide a walking assistance device that can store an electric/electronic unit so as to be readily accessible.

A third object of the present invention is to provide a walking assistance device that can store an electric/electronic unit so as to shield the user from the heat generated by the electric/electronic unit.

According to the present invention, such objects can be accomplished by providing a walking assistance device configured to apply a walking assistance force to a femoral part of a user, comprising: a pelvic support assembly configured to be worn on a pelvic part of a user to support a power generator and a femoral support assembly configured to transmit a walking assistance force generated by the power generator to a femoral part of the user; wherein the pelvic support assembly comprises a main frame configured to be worn on a pelvic part of the user and extending from a lower back of the user to either side of the pelvic part of the user forming a C-shape in plan view, at least one free end of the main frame being configured to support the power generator at a position corresponding to a hip joint of the user, and an abdominal belt attached to the main frame at base ends thereof, extending along an inner periphery of the main frame and configured to be detachably passed along an abdominal part of the user; and wherein the main frame is provided with an opening in a middle part thereof, and an electronic unit is received in the opening.

The electronic unit as used herein includes, not exclusively, an electric circuit, an electronic circuit, a control circuit, a power circuit, a battery, a telecommunication unit or the like. As the electronic unit is placed in the middle part of the main frame which is relatively free from deformation, the electronic unit is protected from deformation or stress that could impair the reliability of the electronic unit.

According to a preferred embodiment of the present invention, the opening is passed through a thickness of the middle part of the main frame and a bottom plate closes an end of the opening facing away from the user. Preferably, the electronic unit is incorporated in the bottom plate, and the bottom plate is formed with a receptacle for receiving a battery therein in a detachable manner.

If the electronic unit is secured to the main frame at a laterally central part of the electronic unit, the transmission of the deformation of the pelvic frame to the electronic unit can be minimized. To ensure a secure and stable attachment of the electronic unit to the main frame, the electronic unit may be secured to the main frame at an upper and lower laterally central part of the electronic unit. To insulate the electronic unit from the deformation of the main frame, the electronic unit may be secured to the main frame via a resilient member.

When the main frame is provided with an opening in a middle part thereof, and an electronic unit is received in the opening, an electric cable extending from the electronic unit to the power generator may be passed inside the main frame so as to ensure a high reliability and conceal the lead wire from view.

To achieve both an easy access to the electronic unit, and an attractive appearance, the opening may be provided with a lid that selectively closes the opening from a side adjacent to the user. According to a particularly preferred embodiment of the present invention, the lid is formed as a back support member for supporting a back part of the user. As the lid serves the dual purposes, the weight and cost of the device can be minimized. For the convenience of the handling of the lid, the lid may be supported by the main frame via a hinge provided adjacent to an edge of the opening.

To enhance the capability of the back support member to conform to the body of the user, and to minimize the transmission of heat from the electronic unit to the user, the back support member may be provided with a plurality of vertical slots arranged along a lateral direction.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
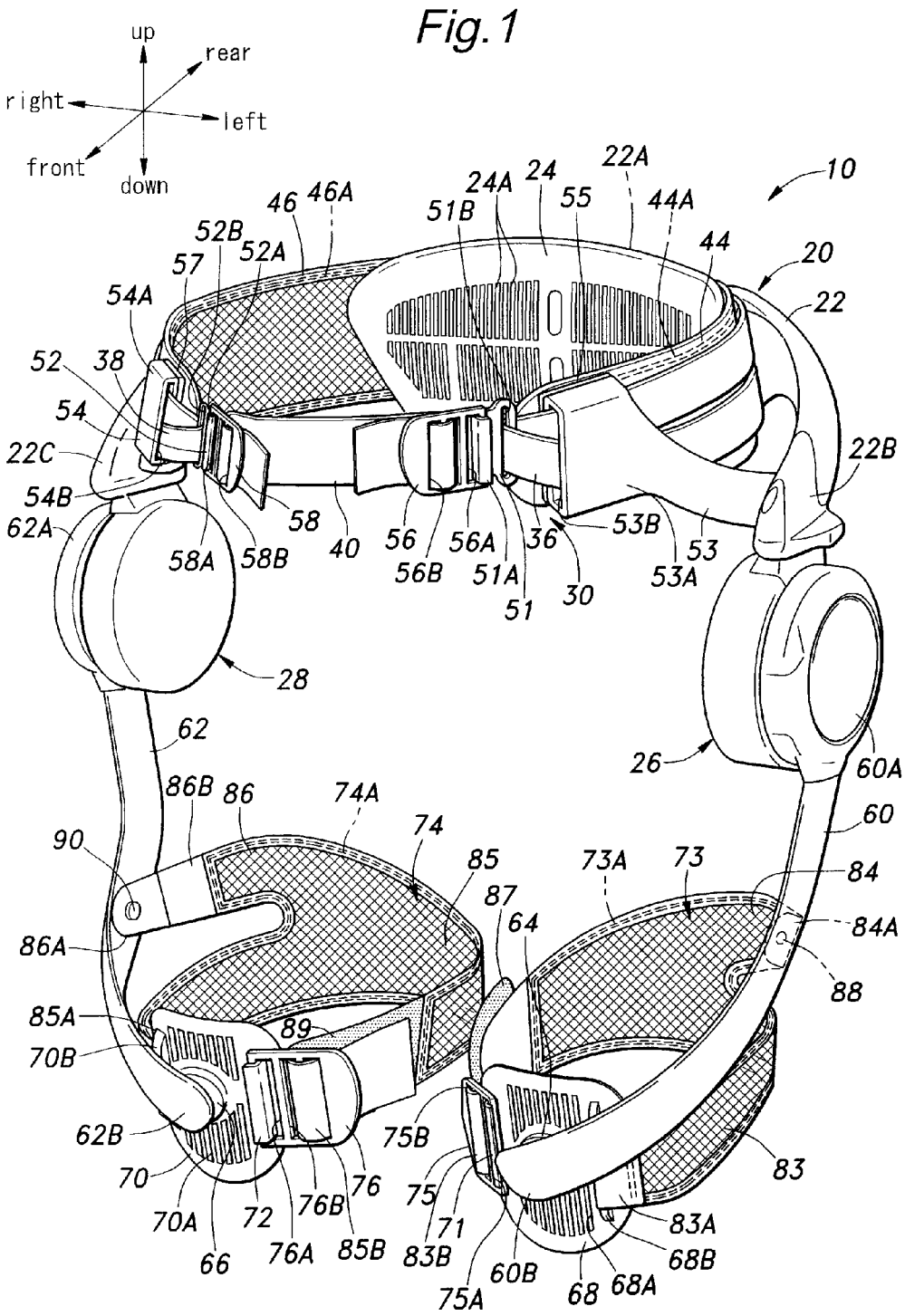
FIG. 1 is a perspective view of a walking assistance device embodying the present invention.

An embodiment of the walking assistance device of the present invention will now be described in the following with reference to FIG. 1. In the following description, the direction of the walking assistance device will be based on the directional arrows shown in each of the drawings. When the device is worn by the user, the front and back directions of the walking assistance device coincide with the coronal axis, while the left and right directions coincide with the sagittal axis.

The walking assistance device 10 is provided with a pelvic support assembly 20. The pelvic support assembly 20 is configured to be worn on the pelvic part of the user, and includes a main frame 22 that extends outwardly from a lower back part of the user to either side of the pelvic part to form a C-shape when viewed in plan view. The main frame 22 is formed with molded plastic material such as polyamide resin, glass fiber reinforced plastic material, carbon fiber reinforced plastic material or other material having a high stiffness and mechanical strength.

A middle part 22A of the main frame 22 is formed with a storage opening (FIG. 2) passed across the thickness thereof for receiving an electronic unit including a control unit and a battery. A back support member 24 is attached to the inner side of the middle part 22A of the main frame 22. The back support member 24 is made of a plastic plate member having a high resiliency, and is formed with a number of vertical slots 24A arranged laterally at a regular interval for promoting air permeability and enhancing resiliency with the aim of improving the comfort of the user.

A left end part 22B and a right end part 22C on either side of the main frame 22 are positioned outwardly on either side of the user, and are each provided with a power generator mainly consisting of a motor unit 26, 28. The upper end of each motor unit 26, 28 is connected to the corresponding end part 22B, 22C of the main frame 22 via a hinge having a hinge axis extending in the coronal axis (front/back directional axis) of the user so that the motor unit 26, 28 is suspended from the upper end part, and can rotate around the hinge axis within a prescribed angular range.

Along the inner side of the main frame 22 extends an abdominal belt 30, which is wrapped around the abdominal part of the user. The abdominal belt 30 of this embodiment includes a left side belt 36, a right side belt 38 and a front belt 40. These parts 36, 38 and 40 are each made of flexible materials such as fabric and leather.

The left side belt 36 is passed through an opening 51B of a left engagement piece 51, and the two ends of the left side belt 36 are attached to an upper and lower part of the inner side of the middle part 22A of the main frame 22, respectively, so as to form a loop. Therefore, the left side belt 36 is reversed over in the shape of letter V at the left engagement piece 51. The length of the left side belt 36 can be adjusted by using a belt length adjustment buckle (not shown in the drawings) provided in a middle part of the belt. The left hook engagement piece 51 is made of plastic or metallic material, and is further provided with a left hook shaped part 51A.

Similarly, the right side belt 38 is passed through an opening 52B of a right engagement piece 52, and the two ends of the right side belt 38 are attached to an upper and lower part of the inner side of the middle part 22A of the main frame 22, respectively, so as to form a loop. Therefore, the right side belt 38 is reversed over in the shape of letter V at the right engagement piece 52. The length of the right side belt 38 can be adjusted by using a belt length adjustment buckle (not shown the drawings) provided in a middle part of the belt. The right engagement piece 52 is made of plastic or metallic material, and is further provided with a right hook shaped part 52A.

In the illustrated embodiment, each of the left and right engagement pieces 51 and 52 is made of a flat plate member having a slightly greater width than the belts 36 and 38.

Each end of the front belt 40 is fitted with a buckle 56, 58 provided with an opening 56A, 58A configured to receive the hook shaped part 51A, 52A of the corresponding engagement piece 51, 52. Each of the buckles 56, 58 is provided with a pair of rectangular openings 56B and 58B separated by a lateral bar for passing the corresponding end of the front belt 40 in a length adjustable manner. The left and right buckles 56 and 58 are each made of a flat plate member having a slightly greater width than the front belt 40.

Therefore, the front belt 40 can be detachably connected to the left and right side belts 36 and 38 by engaging the hook shaped parts 51A and 52A of the engagement pieces 51 and 52 with the openings 56A and 58A of the corresponding buckles 56 and 58. When the three parts of the abdominal belt 30 are connected to one another as described above, the abdominal belt 30 forms a loop that surrounds the abdominal part of the user. By suitably adjusting the length of each part of the abdominal belt 30 and snugly wrapping the abdominal belt 30 around the abdominal part of the user, the main frame 22 can be securely fitted to the pelvic part of the user without causing discomfort to the user.

The pelvic support assembly 20 further comprises a left supporter piece 44 and a right supporter piece 46. Each supporter piece 44, 46 is made of relatively stiff sheet member having a vertical width greater than the combined width of the two runs of the corresponding abdominal belt 36, 38 extending along the outer surface of the supporter piece 44, 46. Each supporter piece 44, 46 has a base end located between the back support member 24 and corresponding side belt 36, 38, and is jointly secured to the main frame 22, and extends along the inner surface of the side belt 36, 38. To impart a suitable stiffness to each supporter piece 44, 46, a resilient plastic or metallic wire 44A, 46A may be incorporated in the supporter piece 44, 46, for instance, along the outer periphery thereof.

Thus, the supporter pieces 44 and 46 are flexible enough to conform to the contour of the pelvic part of the user but stiff enough to distribute the pressure from the left and right side belts 36 and 38 over a large area of the body of the user so that the comfort of the user may be enhanced. Also, in order to increase the air breathability, and ensure the comfort to the user in a warm weather, the supporter pieces 44 and 46 may be at least partly made of a mesh type fabric or other air permeable material.

The base end of the left supporter piece 44 is secured to the middle part 22A of the main frame 22, and extends between the back support member 24 and left abdominal belt 36 as mentioned earlier. The free end of the left supporter piece 44 terminates at a point adjacent to the left engagement piece 52 in the illustrated embodiment, but may also extend slightly beyond the left engagement piece 52.

Similarly, the base end of the right supporter piece 46 is secured to the middle part 22A of the main frame 22, and extends between the back support member 24 and right abdominal belt 38. The free end of the right supporter piece 46 terminates at a point adjacent to the right engagement piece 54 in the illustrated embodiment, but may also extend slightly beyond the left engagement piece 52. The right supporter piece 46 extends along the side of the user in a similar fashion as the left supporter piece 44.

A stabilizer member 53, 54 is connected to each end part 22B, 22C of the main frame 22. Each stabilizer member is made of an elongated, relatively stiff plastic member having a base end pivotally attached to the inner side of the corresponding end part 22B, 22C via a pivot member so as to be rotatable around a pivot axis substantially in parallel with the sagittal axis or so as to be rotatable in the vertical direction.

Each stabilizer member 53, 54 has a free end 53A, 54A formed with a passage 53B, 54B through which the two runs of the corresponding side belt 36, 38 are passed. The passage 53B, 54B has a certain length so that the stabilizer member 53, 54 may evenly engage a corresponding length of each run of the belt. The free end 53A, 54A of each stabilizer member 53, 54 is attached to a free end part of the corresponding supporter piece 44, 46 via a cushioning member 55, 57 such as a foamed plastic piece.

The stabilizer members 53 and 54 are made of a relatively stiff molded elastomeric material such as vulcanized rubber. The main part of each stabilizer member 53, 54 consists of a strip member having a relatively large width as compared to the thickness thereof and having a major plane extending along the outer contour of the abdominal part of the user. Therefore, the stabilizer members 53 and 54 are compliant in the direction to conform to the outer contour of the abdominal part of the user, but is relatively stiff against the bending deformation in the vertical direction.

As the abdominal belt 30 is fastened around the abdominal part of the user, and is tightened, the stabilizer members 53 and 54 deflect inwardly against the body or the user, and the free ends 53A and 54A thereof are placed adjacent to or slightly above the anterior superior iliac spine of the user.

Each electric motor unit 26, 28 is positioned so as to coincide with the corresponding hip joint of the user, and is provided with an angular sensor (not shown in the drawings). To the output end of each electric motor unit 26, 28 on the exterior side thereof is releasably attached a base end part 60A, 62A of a swing arm 60, 62 in a torque transmitting relationship.

Figure 2:
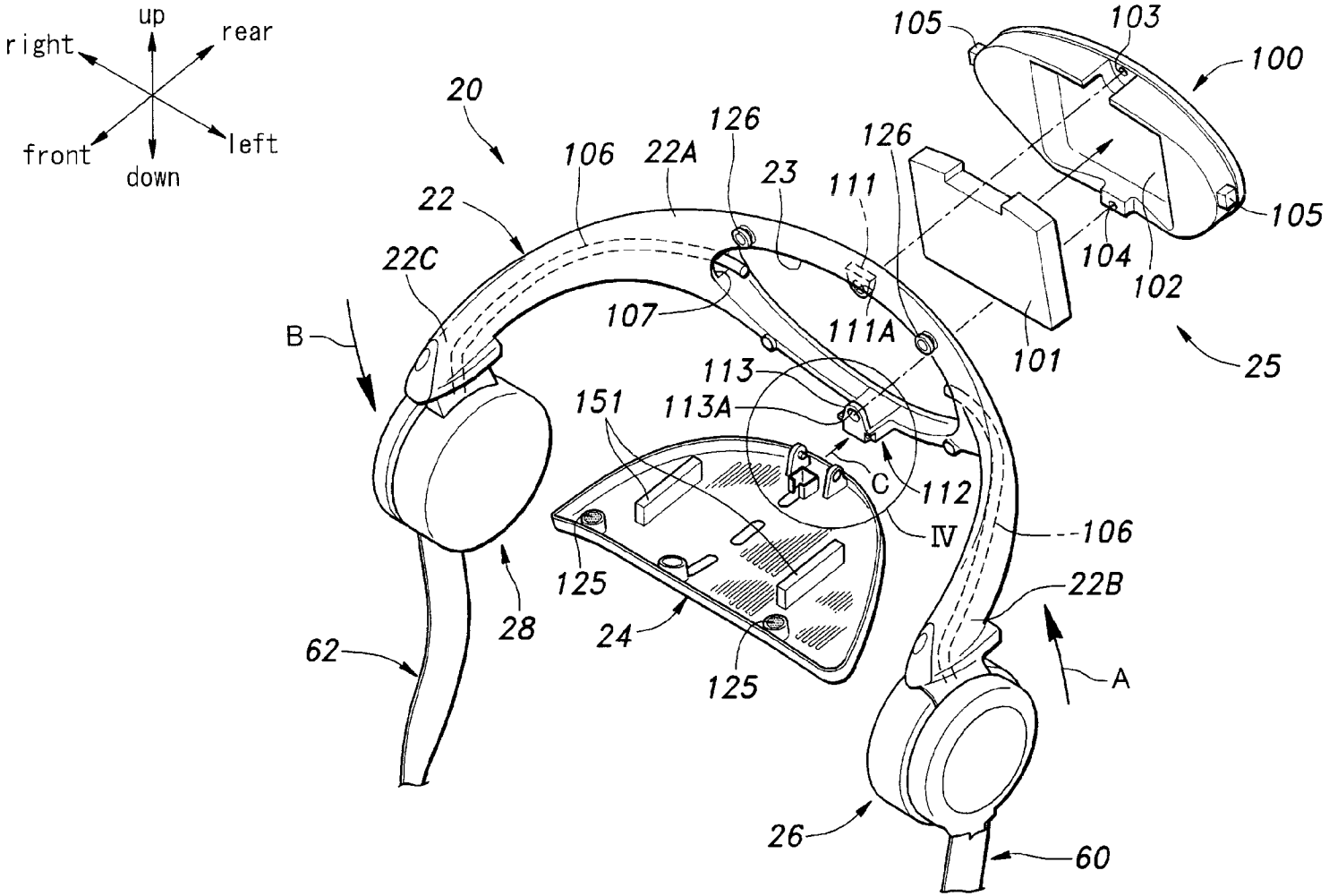
FIG. 2 is an exploded perspective view of a pelvic support assembly of the walking assistance device.

Each swing arm 60, 62 is made of highly stiff and strong material such as aluminum, glass fiber reinforced plastic material, and carbon fiber reinforced plastic material. The main part of each swing arm 60, 62 consists of a hollow member having an elliptic cross section as illustrated in FIG. 2. The cross section of each swing arm 60, 62 is highly elongated along a major plane extending perpendicularly to the sagittal axial at the base end 60A, 62A thereof. Each swing arm 60, 62 is generally twisted so that the major plane of the free end 60B, 62B, which is located adjacent to a lower end of the femoral part, extends perpendicularly to the coronal axis.

The free end 60B, 62B of each swing arm 60, 62 is fitted with a front femoral support member 68, 70 via a coupling 64, 66 that permits angular movement of the femoral support member 68, 70 relative to the free end 60B, 62B of the swing arm 60, 62. Each front femoral support member 68, 70 is formed of a substantially rectangular plate member made of plastic material, and is curved in the shape of a part-cylindrical surface so as to conform to the outer contour of the lower femoral part of the user. Each front femoral support member 68, 70 is formed with a number of vertical slots 68A, 70A arranged laterally at a regular interval for promoting air permeability and enhancing resiliency with the aim of improving the comfort of the user.

Each femoral support member 68, 70 is fitted with a femoral belt 73, 74 for retaining the femoral support member 68, 70 to the femoral part of the user as shown in FIG. 1. Each femoral belt 73, 74 includes a main belt portion 83, 85 that surrounds the femoral part of the user in cooperation with the corresponding femoral support member 68, 70, and an auxiliary belt portion 84, 86 integrally bifurcated from an intermediate part of the main belt portion 83, 85. The two femoral belts 73 and 74 are mirror images of each other.

The femoral support assembly is now described in the following. As the two femoral support assemblies are mirror images of each other, only the right femoral support assembly is described in the following. A first end 83A of the main belt portion 83 is secured to a belt engaging bar 68B extending vertically on one lateral side of the femoral support member 68, and a second end 83B of the main belt portion 83 is fitted with a tongue piece 75. The tongue piece 75 includes four lateral bars and a pair of longitudinal bars connecting the corresponding ends of the lateral bars. The femoral belt 73 is passed through an opening 75B defined between the second and third lateral bars from inside to outside, and is then passed through the opening defined between the first and second lateral bars from outside to inside, the lateral bars being counted from the end adjacent to the femoral belt 73. Thus, the free end of the femoral belt 73 is passed between the first lateral bar and the remaining part of the femoral belt, from outside to inside. Thus, the femoral belt 73 is frictionally engaged against loosening when fastened while enabling the femoral belt 73 to be tightened by pulling the free end of the femoral belt 73. In the illustrated embodiment, a surface fastener 87 is attached to the outer side of the free end of the femoral belt 73 so that the parts of the femoral belt overlying each other near the base end of the tongue piece 75 can be joined to each other, and the femoral belt 73 is positively prevented from slackening during use.

If desired, the surface fastener may also be applied to the abdominal belt 30 or in particular the front belt 40 for the purpose of preventing the loosening or slackening of the abdominal belt 30.

The femoral support member 68 is formed with a hook portion 71 on the opposite lateral side thereof. The hook portion 71 is formed on the front side of the femoral support member 68 so as to define a hook opening facing away from the adjacent lateral edge of the femoral support member 68. Thereby, the tongue piece 75 can be secured to the femoral support member 68 by engaging the hook portion 71 in the opening defined between the first and second lateral bars of the tongue piece.

The free end of each auxiliary belt part 84 is fitted with a grommet 84C, and is connected to an intermediate part of the corresponding swing arm 62 via a pivot pin 88 fixedly secured to the swing arm 60 and rotatably received in the grommet 84C.

Thus, the main belt portion 83 is wrapped around the femoral part of the user by securing the base end of the main belt portion 83 to the belt engaging bar 68B of the femoral support member 68 and engaging the tongue piece 75 with the hook portion 71 provided on the opposite lateral end of the femoral support member 68.

The main belt portions 83 and 85 as well as the auxiliary belt portions 84 and 86 may be made of any flexible material such as fabric and leather, and may be at least partly made of mesh material as denoted in numerals 73B and 74B. Resilient plastic wires 73A, 73B are incorporated along the lateral edges of the mesh material 73B, 74B so that the femoral belt 73, 74 may maintain a curved shape so that the handling of the femoral belt 73, 74 may be improved during the fastening and releasing of the femoral belt.

In the illustrated embodiment, the auxiliary belt portions 84 and 86 are at least partly incorporated with elastic rubber belts 84B and 86B so that the variation in the build of the user may be accommodated by the extension and contraction of the auxiliary belt portions 84 and 86, and the comfort of the user may be improved.

Each femoral belt 73, 74 including the main belt portion 83, 85 and auxiliary belt potion 84, 86 assumes an inverted frustoconical shape when the free end of the main belt portion 83, 85 is connected to the femoral support member 68, 70 via the belt buckle including the tongue piece 75, 76 and the hook portion 71, 72 so as to conform to the outer contour of the lower femoral part of the user. Thus, each femoral belt 73, 74 may be shaped three-dimensionally by using the draping technique so as to optimally conform to the femoral part of the user.

Thus, the free end of each swing arm 60, 62 can engage the lower part of the corresponding femoral part of the user by passing the femoral belt 73, 74 around the femoral part of the user, and engaging the hook-shaped part 71, 72 with the opening 75A, 76A of the corresponding tongue piece 75, 76. By appropriately tightening the femoral belt 73, 74 by using the tension adjusting feature of the tongue piece 75, 76, the femoral part of the user can be securely but releasably engaged by the free end of the swing arm 60, 62.

By actuating the motor units 26 and 28 in dependence on the walking effort made by the user (which can be detected by using suitable load sensors not shown in the drawings), the user is assisted in the effort to walk not only by the assisting power provided by the motor units 26 and 28 but also by the gait or pace also provided by the motor units 26 and 28 for the purpose of helping the user regain the motor coordination required for walking. The motor units 26 and 28 are provided with angular sensors so that the angular movements of the motor units 26 and 28 may be accurately controlled by feedback control.

Figure 3:
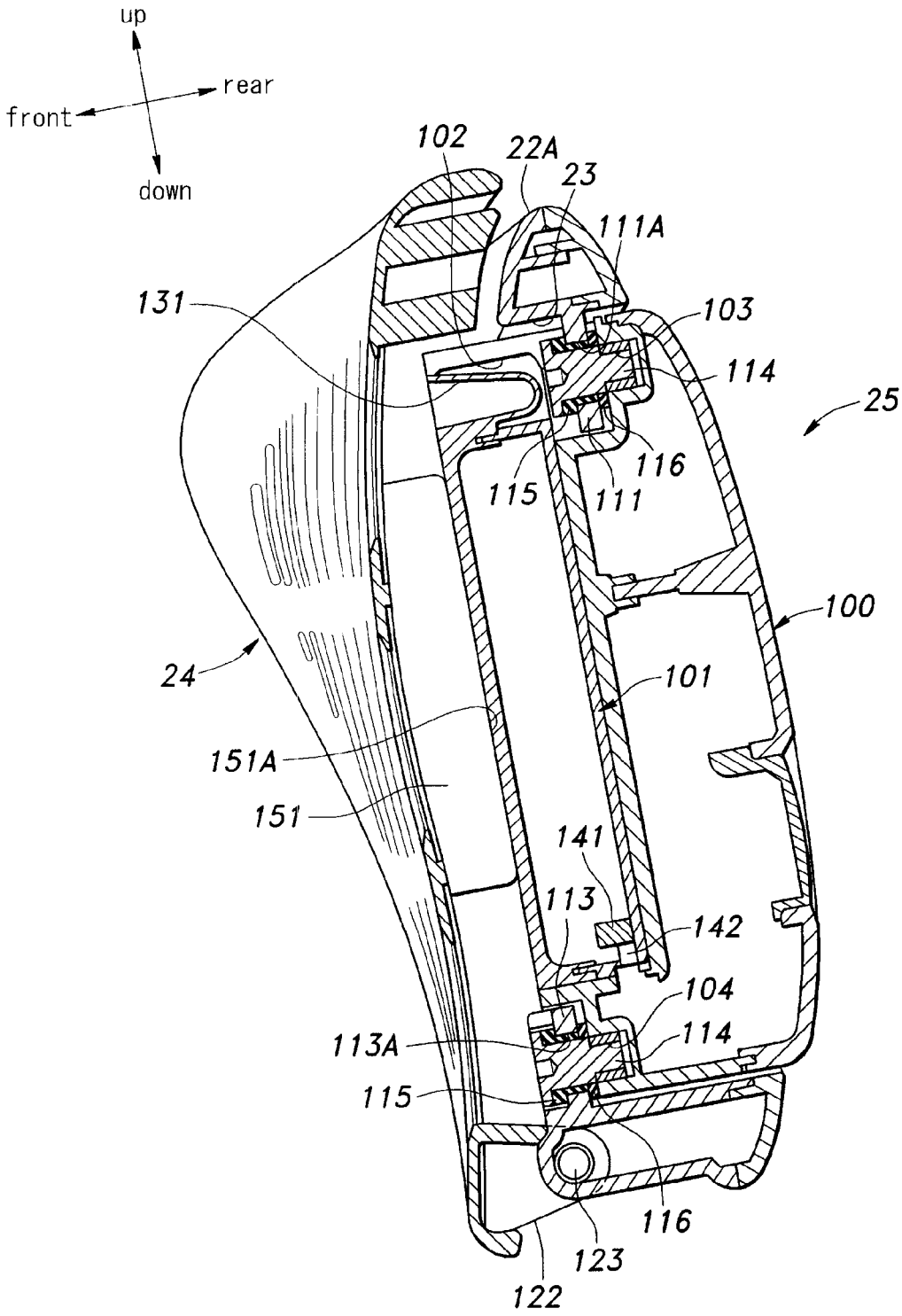
FIG. 3 is a sectional view of a middle part of a main frame of the pelvic support assembly.
Figure 4:
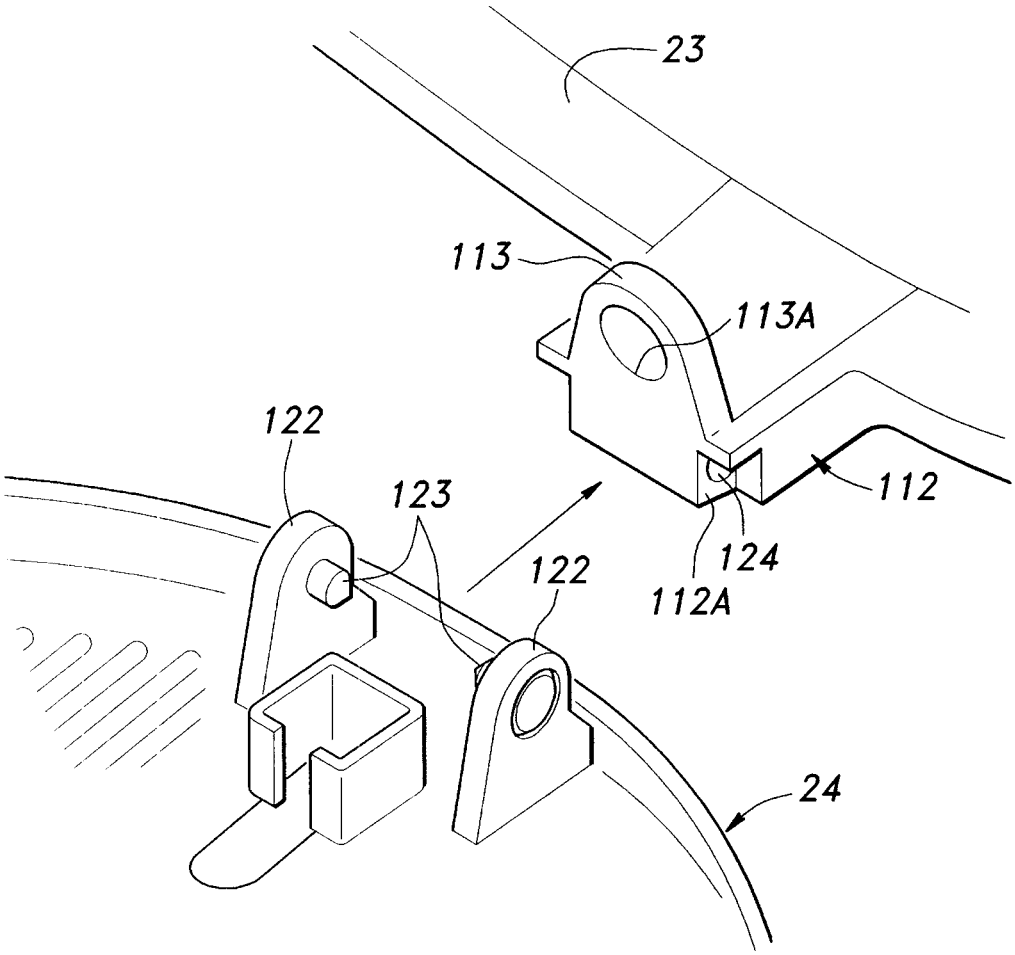
FIG. 4 is a fragmentary exploded perspective view of a hinge assembly of the main frame.

Referring to FIGS. 2 to 4, the electronic unit 25 comprises a unit main body 100 which is received in an opening 23 having an elliptic cross section and passed across the thickness of the main frame 22. In particular, the unit main body 100 is loosely fitted in the opening 23 as will be discussed hereinafter. The unit main body 100 is formed as a bottom plate that closes the opening 23 from the side remote from the user, and is internally provided with an electronic control unit (not shown in the drawings). The electronic control unit may be molded or otherwise sealed within the unit main body 100. The side of the unit main body 100 facing the user is formed with a rectangular receptacle 102 that receives a battery 101 in a detachable manner. The battery 101 provides the electric power required for the operation of the control unit in the unit main body 100 and the electric motor units 26 and 28. An upper threaded hole 103 and a lower threaded hole 104 are passed centrally at an upper and lower end of the unit main body 100, respectively.

A pair of grommets 105 made of elastomeric material are fitted on either lateral end of the unit main body 100. Electric cables 106 are passed through these grommets 105, and then into holes 107 formed in the lateral wall defining the opening 23. The electric cables 106 are passed through the hollow interior of the main frame 22, and connect the motor units 26 and 28 with the electronic unit 25 for exchanging electric signals and feeding the electric power to the motor units 26 and 28.

An upper engagement piece 111 projects from the upper wall defining the opening 23, and a lower engagement piece 113 similarly projects from the lower wall defining the opening 23. These engagement pieces 111 and 113 are centrally located with respect to the lateral direction.

The unit main body 100 is fixedly secured to the main frame 22 by using a pair of threaded bolts 114 which are passed through holes 111A and 113A formed in the engagement pieces 111 and 113, and threaded into the upper and lower threaded holes 103 and 104, respectively. A rubber bush 115, 116 is interposed between each threaded bolt 114 and the corresponding holes 111A, 113A.

During use, the main frame 22 may undergo some twisting deformation around the middle part 22A thereof as indicated by arrows A and B in FIG. 2 due to the reaction of the electric motors 26 and 28 applying a walking assistance force to the femoral parts of the user. As the unit main body 100 is loosely fitted in the opening 23, is located centrally of the main frame 22, and is supported therein via resilient members such as the rubber bushes 115 and 116, the deformation of the main frame 22 is prevented from being transmitted to the unit main body 100. In particular, the unit main body 100 is supported via the upper and lower engagement pieces 111 and 113 which are located centrally with respect to the lateral direction, and this is particularly beneficial in deformation free support of the unit main body 100.

The back support member 24 is connected to the main frame 22 via a hinge assembly 121. As best shown in FIG. 4, the lower engagement piece 113 is connected to the main frame 22 via a coronal extension 112 extending from the part of the main frame 22 immediately below the lower central edge of the opening 23. The lateral sides of the coronal extension 112 are provided with pivot holes 124 disposed in a coaxial relationship. The lower end of the back support member 24 on the side facing away from the user is provided with a pair of elastic projections 122 laterally opposing each other, and provided with pivot pins 123 projecting toward each other in a coaxial relationship. These pivot pints 123 are placed in the corresponding pivot holes 124 of the coronal extension 112 by resiliently forcing the elastic projections 122 away from each other, and releasing the elastic projections 122 to the initial positions once the pivot pints 123 are received in the pivot holes 124. The lateral sides of the coronal extension 112 in which the pivot holes 124 are formed are given with a tapering surfaces so that the pivot pints 123 can be easily received in the pivot holes 124 by pushing the coronal extension 112 into the gap between the two elastic projections 122 as indicated by an arrow C in FIG. 2.

The lower end of the unit may body 100 was connected with the part of the main frame 22 adjacent to the central part of the lower edge of the opening 23 via the hinge assembly 121, but it is also possible to connect the upper end of the unit main body 100 with the part of the main frame 22 adjacent to the central part of the upper edge of the opening 23 via a similar hinge assembly as can be readily appreciated by a person skilled in the art. It is even possible to provide a hinge assembly on a lateral edge of the opening 23.

The upper end of the back support member 24 is provided with a pair of engagement portions 125 on the side of the back support member 24 facing away from the user. The engagement portions 125 comprises permanent magnet pieces that cooperate with associated engagement portions 126 made of iron and provided on the main frame 22. The associated engagement portions 126 are configured so as to come into engagement with the engagement portions 125 and get magnetically attached thereto when the back support member 24 is swung upward around the hinge assembly 121, and closes the opening 23 from the side of the user. Thus, the back support member 24 is enabled to close the opening 23 when desired, and can be held in the closed position by the magnetic attraction between the engagement portions 125 and associated engagement portions 126.

Owing to the structure of the back support member 24 discussed above, the user can easily gain access to the electronic unit 25 simply by opening the back support member 24 via the hinge assembly 121.

Figure 5A:
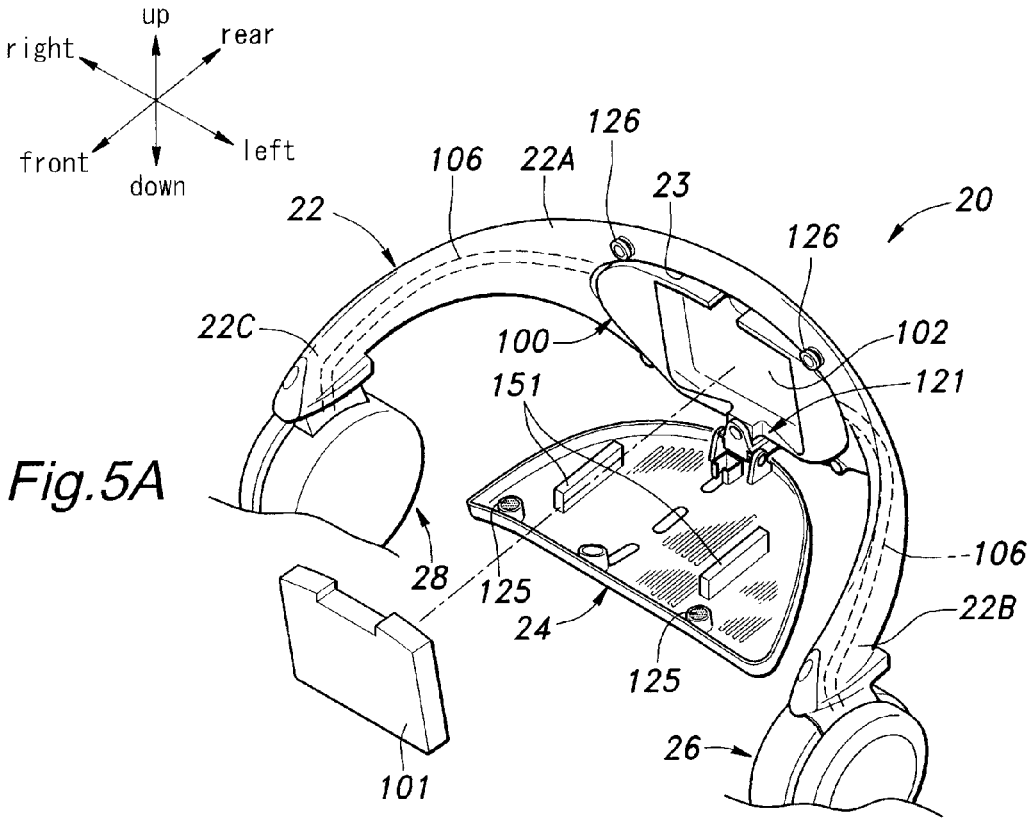
FIGS. 5A and 5B are fragmentary perspective views showing how an electronic unit is received in an opening formed in the middle part of the main frame and how the opening is closed by a lid.
Figure 5B:
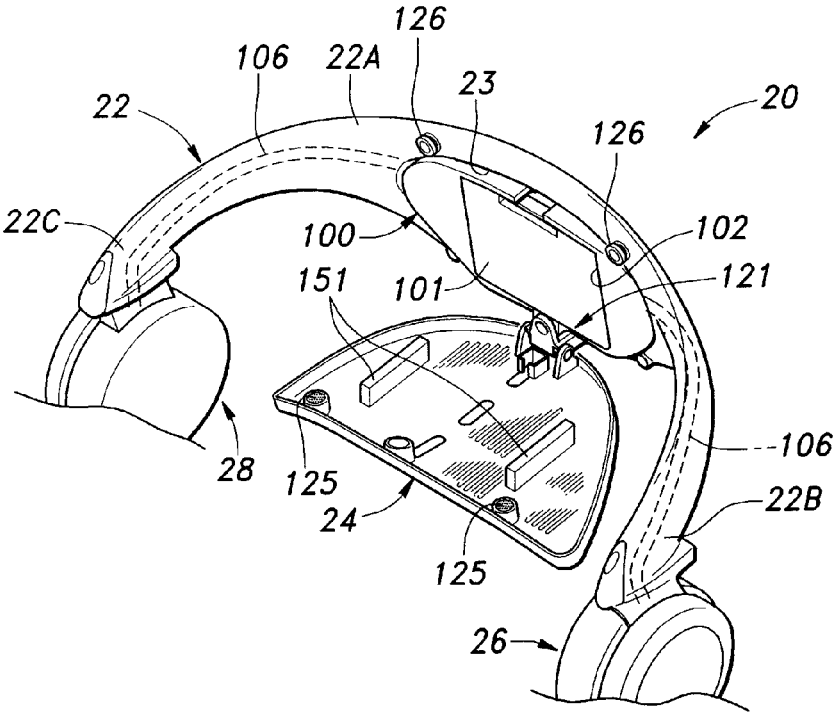
Figure 6A:
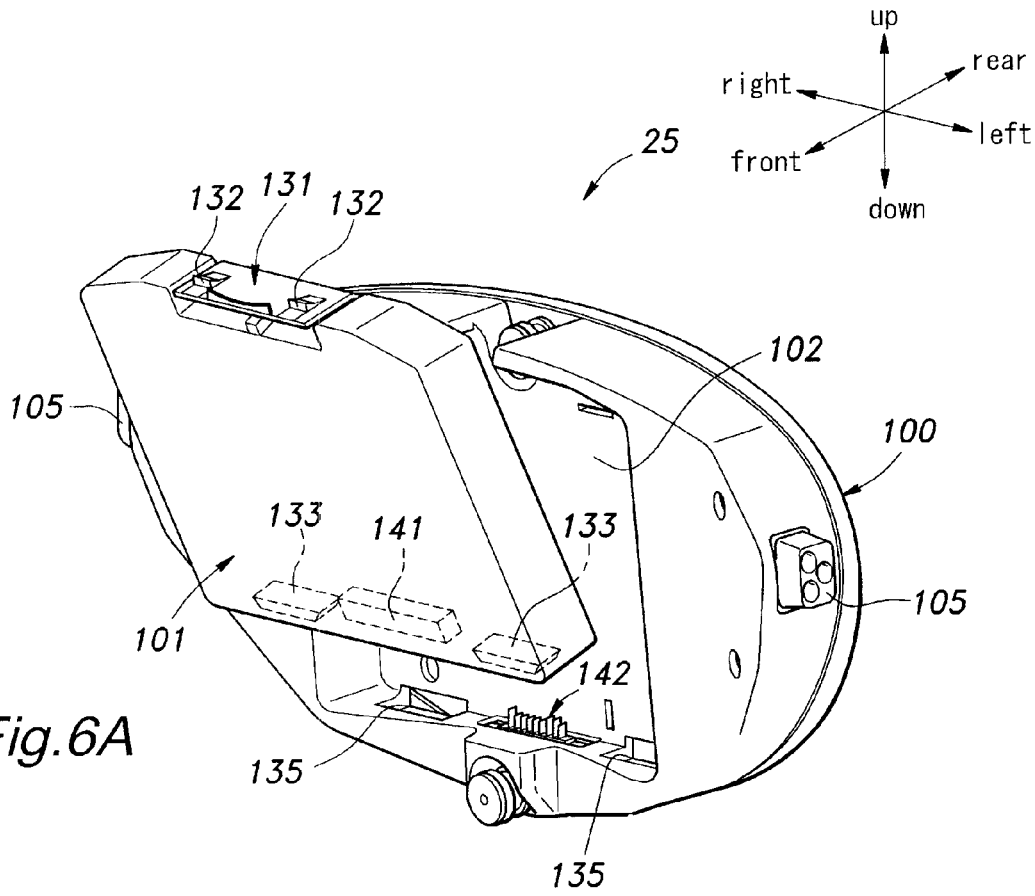
FIGS. 6A and 6B are perspective views showing how a battery is received in a receptacle formed in a bottom plate.
Figure 6B:
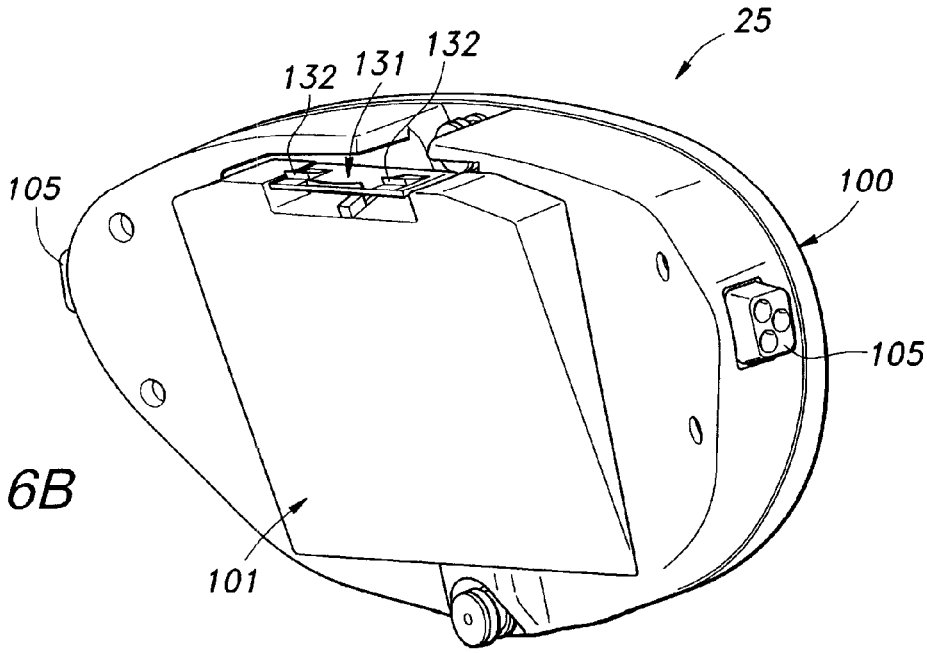
Figure 7:
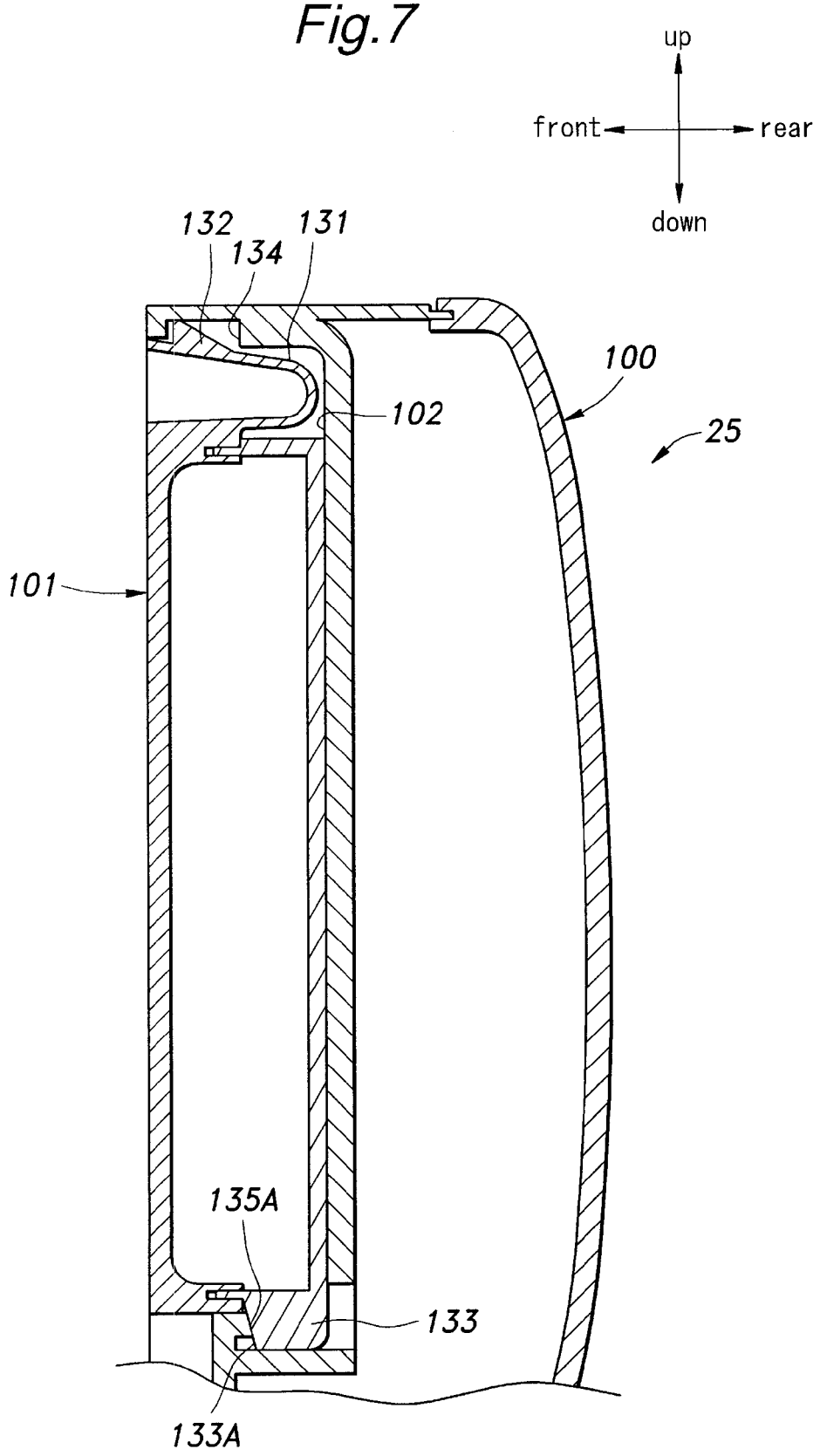
FIG. 7 is a vertical sectional view showing how the battery is retained in the receptacle.

When the opening 23 is exposed by swinging the back support member 24 downward around the hinge assembly 121, the battery 101 can be placed into the receptacle 102 and taken out of the receptacle 102 as required, as illustrated in FIGS. 5A and 5B. As shown in FIGS. 6 and 7, the upper central part of the battery 101 is provided with a U-shaped sheet spring 131 having a pair of engagement claws 132, and the upper wall of the receptacle 102 is provided with a pair of engagement recesses 134 configured and positioned so as to receive the engagement claws 132. The lower end of the battery 101 is provided with a pair of projections 133 configured to be received by a pair of corresponding recesses 135 formed in the lower wall of the receptacle 102.

Therefore, by placing the projections 133 in the recesses 135 formed in the lower wall of the receptacle 102, and pushing the battery 101 into the receptacle 102, the engagement claws 132 are resiliently engaged in the corresponding recesses 134 formed in the upper wall of the receptacle 102. This snap fit action is facilitated because the side 133A of each projection 133 facing the user is tapered, and the corresponding side wall 135A of the corresponding recess 135 is given with a complementary taper.

When the battery 101 is fully received in the receptacle 102, battery terminals 141 (FIG. 6A) provided centrally in the lower end of the battery 101 are electrically connected to unit terminals 142 provided centrally in the lower wall of the receptacle 102. The battery 101 can be recharged by using a battery recharger (not shown in the drawings) which is configured to recharge the battery 101 via the battery terminals 141.

The removal of the battery 101 can be accomplished in an equally simple manner. By depressing the U-shaped sheet spring 131 downward, the engagement between the engagement claws 132 and engagement recesses 134 can be released, and the battery 101 can be taken out of the battery receptacle 102 by tilting it around the lower end thereof.

As shown in FIG. 2, the side of the back support member 24 facing away from the user is provided with a pair of vertically extending ribs 151 that are configured to be pushed against the opposing surface of the battery 101 at free ends 151A thereof when the back support member 24 is closed. If desired, the vertically extending ribs 151 may be made of elastomeric or other resilient material.

As the back support member 24 is used as a lid for the battery receptacle 102, the access to the battery 101 is facilitated, and the need for special members that are dedicated for the retaining of the battery 101 can be eliminated. As the battery 101 is detachably received in the unit main body 100, the battery 101 or in particular the battery terminals 141 are prevented from being affected by the deformation of the main frame 22 during use.

The back support member 24 was provided with vertically extending slots 24A in the illustrated embodiment, but may be perforated or otherwise given with an air permeable property for affording a favorable resiliency or flexibility to the back support member 24. Also, the electronic unit 25 may generate heat during use. Particularly when the back support member 24 is given with an air permeable property, it can shield the heat generated from the electronic unit 25 to the user.

Although the present invention has been described in terms of a preferred embodiment thereof. It is obvious to a person skilled in the art that various alterations and modifications are possible without departing from the scope of the present invention which is set forth in the appended claims.

The contents of the original Japanese patent applications on which the Paris Convention priority claim is made for the present application are incorporated in this application by reference.

The invention claimed is:

1. A walking assistance device configured to apply a walking assistance force to a femoral part of a user, comprising:

a pelvic support assembly configured to be worn on a pelvic part of a user to support a power generator and a femoral support assembly configured to transmit a walking assistance force generated by the power generator to a femoral part of the user;

wherein the pelvic support assembly comprises a main frame configured to be worn on a pelvic part of the user and extending from a lower back of the user to either side of the pelvic part of the user forming a C-shape in plan view, at least one free end of the main frame being configured to support the power generator at a position corresponding to a hip joint of the user, and an abdominal belt attached to the main frame at base ends thereof, extending along an inner periphery of the main frame and configured to be detachably passed along an abdominal part of the user;

wherein the main frame is provided with an opening in a middle part thereof, the opening is passed through a thickness of the middle part of the main frame, an electronic unit for controlling the power generator is received in the opening, the electronic unit includes a bottom plate configured to close an end of the opening facing away from the user, and the bottom plate is formed with a receptacle on a side thereof facing the user for receiving a battery in the receptacle in a detachable manner; and wherein the opening is provided with a lid that selectively closes the opening from a side adjacent to the user, the side adjacent to the user being opposite to the end of the opening facing away from the user, and the lid is hingedly secured to the main frame via a hinge provided adjacent to an edge of the opening.

2. The walking assistance device according to claim 1, wherein the electronic unit is secured to the main frame at a laterally central part of the main frame.

3. The walking assistance device according to claim 2, wherein the electronic unit is secured to the main frame at an upper and lower laterally central part of the main frame.

4. The walking assistance device according to claim 2, wherein the electronic unit is secured to the main frame via a resilient member.

5. The walking assistance device according to claim 1, wherein an electric cable extends from the electronic unit to the power generator inside the main frame.

6. The walking assistance device according to claim 1, wherein the lid is formed as a back support member for supporting a back part of the user.

7. A walking assistance device configured to apply a walking assistance force to a femoral part of a user, comprising:

a pelvic support assembly configured to be worn on a pelvic part of a user to support a power generator and a femoral support assembly configured to transmit a walking assistance force generated by the power generator to a femoral part of the user;

wherein the pelvic support assembly comprises a main frame configured to be worn on a pelvic part of the user and extending from a lower back of the user to either side of the pelvic part of the user forming a C-shape in plan view, at least one free end of the main frame being configured to support the power generator at a position corresponding to a hip joint of the user, and an abdominal belt attached to the main frame at base ends thereof, extending along an inner periphery of the main frame and configured to be detachably passed along an abdominal part of the user; and wherein the main frame is provided with an opening in a middle part thereof, and an electronic unit for controlling the power generator is loosely fitted in the opening and is fixedly secured to the main frame via engagement parts provided in upper and lower portions of the main frame, wherein the opening is provided with a lid that selectively closes the opening from a side adjacent to the user, the side adjacent to the user being opposite to the end of the opening facing away from the user, and the lid is hingedly secured to the main frame via a hinge provided adjacent to an edge of the opening.

8. The walking assistance device according to claim 7, wherein the lid is formed as a back support member for supporting a back part of the user.

9. The walking assistance device according to claim 8, wherein the back support member is provided with a plurality of vertical slots arranged along a lateral direction.

* * * * *